United States Patent [19]

Izumi

[11] Patent Number: 4,501,121

[45] Date of Patent: Feb. 26, 1985

[54] METHOD OF HEAT EXCHANGE AND REFRIGERATING DEVICES

[76] Inventor: Masahiko Izumi, 13-14, 2-chome, Nishimagome, Oota-ku, Tokyo, Japan

[21] Appl. No.: 479,809

[22] Filed: Mar. 28, 1983

[30] Foreign Application Priority Data

Apr. 23, 1982 [JP] Japan ..... 57-67259

[51] Int. Cl.[3] ..... F24F 3/16

[52] U.S. Cl. ..... 62/78; 62/91

[58] Field of Search ..... 62/78, 91, 64, 304, 62/373, 376, 247

[56] References Cited

U.S. PATENT DOCUMENTS 2,065,358 12/1936 Zarotschenzeff ..... 62/91
2,066,013 12/1936 Murphy et al. ..... 62/91
2,123,742 7/1938 Offen ..... 62/91
3,132,012 5/1964 Walker ..... 62/91

*Primary Examiner*—Ronald C. Capossela
*Attorney, Agent, or Firm*—Browdy and Neimark

[57] ABSTRACT

The present invention relates to a method of heat exchange performed by blowing atomized or sprayed water against an evaporator pipe through which a refrigerant is circulating and by forcing air to circulate through the sprayed water, on to a refrigerating installation or a refrigerator in which the cooled moist air is used. This invention is useful for the refrigeration of cakes and perishable foods, for example, because a substance being refrigerated can be refrigerated while its moisture is prevented from evaporating, since the air cooled by the invention heat method contains tiny water droplets contacts the substance being refrigerated directly.

6 Claims, 6 Drawing Figures

METHOD OF HEAT EXCHANGE AND REFRIGERATING DEVICES

FIELD OF THE INVENTION

The present invention relates to a method of heat exchange wherein atomized or sprayed water is blown against a refrigerant-circulating pipe, in particular the evaporator pipe of a refrigerating machine, and air is forced to circulate through the sprayed water for heat exchange. The invention also relates to a refrigerating device such as a refrigerated showcase, or a refrigerator, to which said method of heat exchange is applied

BACKGROUND OF THE INVENTION

In a refrigerator or refrigerated showcase of the type wherein the substances being refrigerated are placed on holding shelves in the refrigerator or on display racks in the showcase, and a refrigerant gas is made to circulate in direct contact with these substances being refrigerated, low-temperature air obtained from a refrigerating device using a refrigeration cycle, is often used as the refrigerant gas.

In these cases, the low-temperature air has low relative humidity, i.e. it is dry air, since it is obtained by cooling air from outside or by cooling the air in the refrigerator or showcase. Therefore, a phenomenon occurs in which moisture is evaporated from the substances being refrigerated when this dry air is circulated through the refrigerator or showcase.

This phenomenon causes a serious deterioration of the quality of the substances being refrigerated such as cakes, perishable foods, and the like. Even when the refrigeration itself is made satisfactorily, the perishable foods or the like dry out and thereby lose their value as commodities in commerce.

SUMMARY OF THE INVENTION

An object of the present invention is the elimination of the disadvantage described above, which is a chronic problem in conventional refrigerators and refrigerated showcases. In in relation to this object, the invention is characterized in that the cooling air supplied to a refrigerator or display chamber is made to be saturated low-temperature air containing tiny water droplets by injecting cold water into the blow of the air. This saturated air is further cooled to a lower temperature by a cooler and then is sent to the refrigerator or display chamber, in a refrigerator or refrigerated showcase of the type wherein a cooling gas is circulated in direct contact with the substances being refrigerated, such as cakes and perishable foods, which are placed on holding shelves in the refrigerator or on display racks in the showcase. According to the present invention, the possibility of the evaporation of moisture from the perishable foods is eliminated completely even when the cooling gas is in direct contact with the foods, since saturated low-temperature air containing tiny water droplets is used as the cooling gas for cooling the perishable foods and keeping them at low temperature, in direct contact therewith. Thus, the present invention provides a refrigerator or a refrigerated showcase enabling excellent maintenance of the freshness and quality of perishable foods for a long time.

Another object of the present invention is the provision of a method of heat exchange wherein cooled water injected into the flow of cooling air supplied to a refrigerator or a display chamber is sprayed in a spray or an atomized state against an evaporator pipe circulating a refrigerant in a refrigerating machine so as to prevent water from freezing onto the evaporator pipe and thereby reducing the refrigeration effect, and thus a heat exchange action between the refrigerant circulating through the evaporator pipe and the air is facilitated with an increased refrigeration effect.

IDENTIFICATION OF REFERENCE NUMBERS

1 . . . showcase; 2 . . . display section; 3 . . . machinery chamber; 4,5 . . . glass; 6 . . . back plate; 9 . . . shelf plate; 10 . . . display chamber; 11 . . . partition plate; 12 . . . passage; 13 . . . small hole; 14 . . . fan; 16 . . . water pipe; 17 . . . pump; 18 . . . water injection nozzle; 20 . . . cylindrical body; 22 . . . ceiling plate; 24 . . . space; 25 . . . restricted opening; 26 . . . passage; 27 . . . (part of) evaporator coil; 28 . . . duct; 29 . . . small hole; 30 . . . space; 31 . . . bottom plate; 32 . . . cold water tank; 33 . . . (part of) evaporator; 47 . . . evaporator pipe; 70 . . . refrigerator; 72 . . . door; 76 . . . refrigerating machine; 78, 79 . . . communication port; 80 . . . injection nozzle; 84 . . . evaporator pipe; 86 . . . holding chamber; and 87 . . . heat exchange chamber.

DETAILED DESCRIPTION OF PREFERRED EMBODIMENTS

Figure 1:
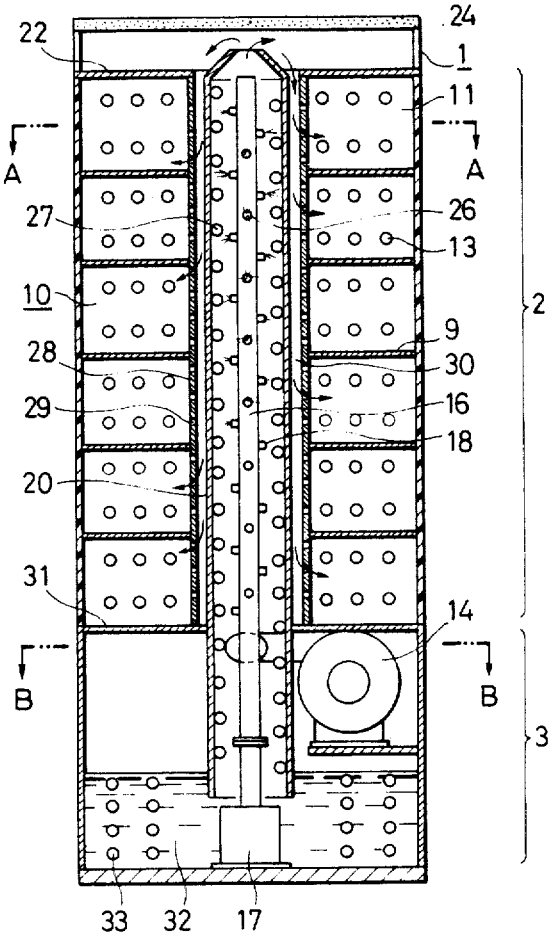
FIG. 1 is a cross-section of part of a refrigerated showcase according to the present invention.
Figure 2:
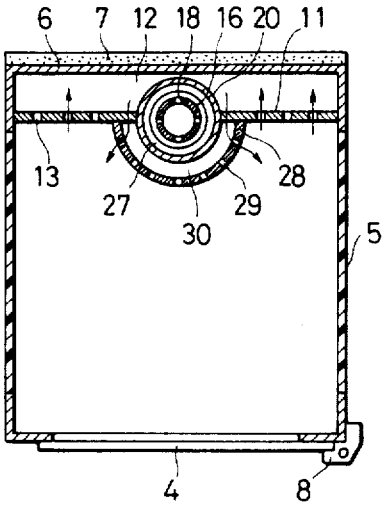
FIG. 2 is a cross-section taken along the line A—A of FIG. 1.
Figure 3:
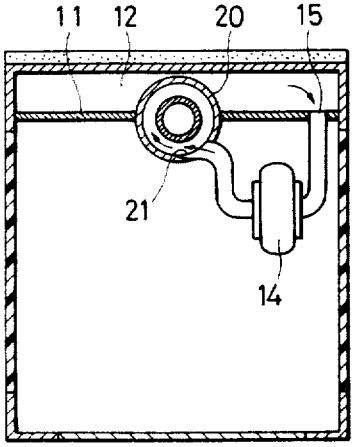
FIG. 3 is a cross-section taken along the line B—B of FIG. 1.
Figure 4:
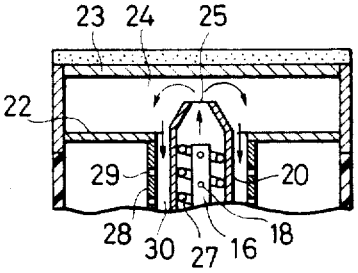
FIG. 4 is a partial cross-section of the upper end of the display section.
Figure 5:
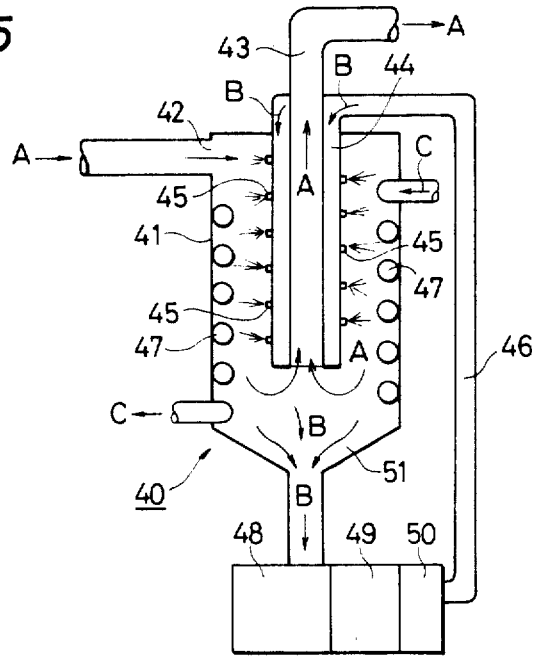
FIG. 5 is a partial cross-section showing a heat exchanger according to the present invention.

Embodiments of the present invention will be described in detail hereunder with reference to the drawings. First, a heat exchange device embodying the method of heat exchange of the present invention will be explained with reference to FIG. 5.

A cyclone 40 is provided with a tangential air inlet 42 in the upper part of a cylindrical part 41 thereof. An outlet pipe 43 is provided in the center of the cylindrical part 41 so as to extend from above downward, and a cold water injection pipe 44 is arranged around the outlet pipe 43 concentrically therewith. The injection pipe 44 is provided with a plurality of injection nozzles 45. An evaporator pipe 47 of a refrigerating device is arranged inside the cylindrical part 41 of the cyclone 40. The evaporator pipe 47 and the injection nozzles 45 are arranged in such a positional relationship that water from the injection nozzles 45 is blown in a spray or atomized state against the evaporator pipe 47. A filter 48, a water tank 49 and a pump 50 are provided in that order at the lower end of a conical part 51 of the cyclone. Accordingly, cold water is made to circulate in the direction of the arrows B, i.e. in the sequence of the pump 50, a circulation pipe 46, the injection pipe 44, the cylindrical part 41 of the cyclone, the conical part 51 thereof, the filter 48, the water tank 49 and the pump 50. A refrigerant, in particular, a high-temperature refrigerant (at about 1° C. to −5° C.), circulates through the evaporator pipe 47 in the direction of the arrows C. Air is sent in the direction of the arrows A, i.e. from the outside of the refrigerator, refrigerated showcase, or the like, into the cyclone through the inlet 42, and is cooled into its saturated state and supplied to the refrigerator, refrigerated showcase, or the like, through the outlet pipe 43.

The following is an explanation of the method of heat exchange according to the present invention wherein the above heat exchange device is utilized. Water sprayed from or atomized by the injection nozzles 45 provided at the injection pipe 44 is blown against the evaporator pipe 47 of the refrigerating device, air is forcedly circulated through the sprayed water so that a heat exchange is made between the refrigerant, in particular, the high-temperature refrigerant circulating through the evaporator pipe 47 and the air, so that the air is thereby cooled into a saturated state and sent into a chamber holding the substances being refrigerated.

An explanation will now be made regarding the refrigerating device, such as a refrigerated showcase, to which the above method of heat exchange is applied, with reference to FIGS. 1 to 4.

The showcase 1 is formed of a display section 2 in the upper part and a machinery chamber 3 in the lower. The front 4 and both sides 5 of the display section 2 are formed of transparent glass plates, while the back thereof is formed of a back 6 made of a steel plate or the like. A heat insulating material 7 is stuck onto the rear surface of the back plate 6. The front glass plate also serves as a door for the display section 2, and has a hinge 8.

A display chamber 10 is formed inside the display section 2 partitioned from the other sections by a ceiling plate 22 and a bottom plate 31. A number of shelf plates 9 for holding the displayed substances are provided in the display chamber 10 fixed at appropriate intervals. Partition plates 11 are provided in the display section 2 in positions comparatively near to, but with a prescribed spacing from, the back plate 6. The partition plates 11 extend to the machinery chamber 3 located below and are fixed so that they are also positioned with a prescribed spacing from the back plate (formed by extending the back plate 6 of the display section 2) of the machinery chamber 3. The phrase "prescribed spacing", which will be described later in detail, is called a passage 12 as well in some places herein, since it also serves as a passage for air. A plurality of small holes 13 communicating the passage 12 with the display chamber 10 are made in the parts of said partition plates 11 corresponding to the display chamber 10, while an opening 15 communicating with a suction port of a fan 14 is formed in a part of the plate 11 at the machinery chamber 3.

A water pipe 16 having a length which extends nearly the full height of the showcase 1, and which introduces cold water, is erected in such a manner that it is positioned in the central part between the partition plates 11. The water pipe 16 is connected, at the lower end, to the discharge port of a pump 17 which is installed in a cold water tank positioned in the lowermost part of the showcase 1, and it has a plurality of water injection nozzles 18 around its periphery in the area inside the display chamber 10. A cylindrical body 20 is arranged around the outer periphery of the water pipe 16 at a prescribed spacing (serving as a passage 26) therefrom, the lower end of the cylindrical body 20 extends to the machinery chamber 3 and has an opening 21 communicating with the exhaust port of the fan 14 therein.

The upper end of the body 20 passes through the ceiling plate 22 of the display chamber 10 and opens with a restricted opening 25, into a space 24 formed between said ceiling plate 22 and the ceiling plate 23 of the showcase. In addition, part 27 of the evaporator coil of a refrigerating cycle mentioned later is positioned in the passage 26 formed between the water pipe 16 and the cylindrical body 20.

A semi-cylindrical duct 28 is provided around the cylindrical body 20 at a prescribed spacing (forming a space 30) from the body 20. This duct 28 extends only within the display chamber 10 and is provided with a plurality of small holes 29 communicating the passage 30 with the inside of the display chamber. The lower end of the duct 28 is in close contact with the bottom plate 31 of the display chamber, while the upper end thereof opens into the space 24.

A cold water tank 32 is formed in the lower part of the machinery chamber 3, the pump 17 is arranged inside this tank 32 to suck up the cold water in the tank. A part 33 of the evaporator of the refrigerating device is arranged inside said tank to cool the water in the tank. The refrigerating device mentioned here is of a conventional type wherein a refrigerating cycle is used, and the members thereof apart from the evaporator are not shown in the figures.

Regarding the operation of the device of this embodiment, water in the cold water tank 32 is cooled by the operation of the refrigerating coils 33, and the water thus cooled is pumped up into the water pipe 16 by the pump 17. It is then injected into the passage 26 from the water injection nozzles 18 provided on the peripheral wall of the water pipe 16. Meanwhile, air is made to flow inside the passage 26 from below by the fan 14, and the cooled water injected into the passage 26 is mixed with this air flow. The air is cooled this cooled by water to become supersaturated low-temperature air containing a large quantity of moisture, and is jetted from the restricted opening 25 into the space 24 above. During this jetting from the restricted opening 25, large water droplets contained in the air are removed and drop along the cylindrical body 20 to return to tank 32. Accordingly, the low-temperature air flowing into the space 24 is placed in a saturated state containing only tiny water droplets, and it flows into the space 30 and then into the display chamber 10 therefrom via the small holes 29 made in the duct 28.

The display chamber 10 communicates with the passage 12 through the plurality of holes 13 in the partition plates 11 forming at the back thereof, while the bottom of the passage 12 communicates with the suction port of the fan 14. Therefore, the cooled air from the space 24 flows through the display chamber 10, cooling the substances being refrigerated in the display chamber, and then is sucked into the fan 14, and thus the flow is continued. In the course of this flow, the mixture of air and cooled water is further cooled down by the evaporator coil 27 provided in the passage 26, as it flows through the passage 26. As a result, the temperature of the mixture (of water and air) becomes even lower, combined with the heat of vaporization of water generated when the cooled water from the water injection nozzles 18 was mixed with the air from the fan 14.

In this way, the cooled air in a saturated state containing low-temperature, tiny water droplets is made to circulate through the display chamber and thereby perishable foods placed on the shelves in the display chamber are refrigerated in the showcase of the present invention. Accordingly, in the refrigeration of the perishable foods, for instance, the foods can be refrigerated and maintained at a low temperature, while the possibility that the foods, the substances being refrigerated, could be dried by the vaporization of moisture therefrom is prevented completely. Therefore, the freshness of perishable foods can be maintained for a long time.

In order to make the cooled air flow uniformly into the display chamber in the showcase, attention must be given to the design of the form, position, number, etc., of the small holes 29 made in the duct 28, and also to make a similar decision with respect to the small holes 13 bored in the partition plates 11. It is also needless to say that such a design is required for the uniform refrigeration of substances being refrigerated when the refrigeration load of each shelf is different.

Figure 6:
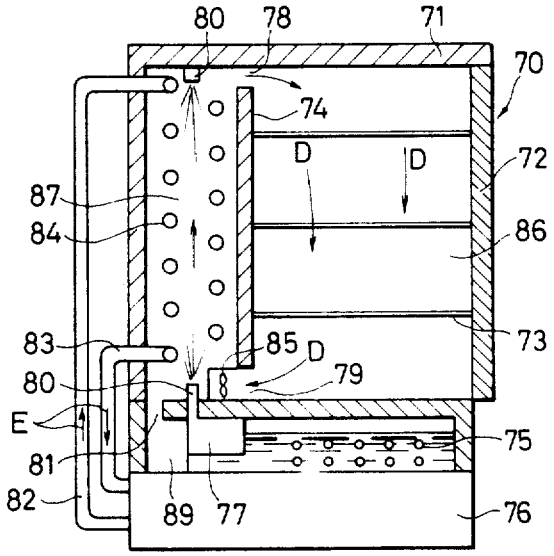
FIG. 6 is a partial cross-section showing a refrigerator according to the present invention.

Lastly, an explanation will be made of a refrigerator whereto the invention method of heat exchange is applied, with reference to FIG. 6. The refrigerator 70 according to the present invention has a chamber 86 for holding the substances being refrigerated and a heat exchange chamber 87 located in the upper part, and a machinery chamber located in the lower. The machinery chamber is mainly composed of a water tank 75 provided with a pump 77, and a refrigerating machine 76. A holding chamber 86 and a heat exchange chamber 87 are formed in the upper part of the refrigerator 70 by partitioning the inside of a wall member 71 by a partition wall 74 which is provided with an upper communication port 78 and a lower communication port 79 communicating the holding chamber 86 with the heat exchange chamber 87. A door 72 enabling the removal or addition of the substances being refrigerated is provided on the front of the holding chamber 86, and shelves 73 holding the substances are provided inside the holding chamber 86. A blower 85 is provided adjacent to the lower communication port 79. An evaporator pipe 84, i.e. the evaporator coil of the refrigerating machine 76 is arranged in the heat exchange chamber 87, and a refrigerant, in particular a high-temperature refrigerant (of about 1° C. to −5° C.), of the refrigerating machine 76 is passed through the evaporator pipe 84 in the direction of the arrows E. An injection nozzle 80 is arranged in the heat exchange chamber 87 so that water can be sprayed therefrom against the evaporator pipe 84. Accordingly, cold water is sent from the water tank 75 to the injection nozzle 80 by the pump 77, is sprayed against the evaporator pipe 84, is then sent into the heat exchange chamber 87, and is then circulated from a discharge port 81 to the water tank 75 through a filter 89.

The refrigerator of the present invention has the above constitution and the operation thereof is similar to that of the refrigerated showcase described before. The following is a simple explanation of the operation of the refrigerator. Water in the water tank 75 may be cooled by the operation of the refrigerating machine. It is not always necessary to cool the water in the water tank 75. The cooled water is sucked up by the pump 77, and sprayed from the injection nozzle 80 against the evaporator pipe 84 circulating the refrigerant, and drops through the heat exchange chamber 87. It is then sent to the filter 89 through the discharge port 81 and gathered again in the water tank 75. Meanwhile, inside the heat exchange chamber 87, air is made to flow from below by the blower 85 provided in the lower part of the chamber 87. Accordingly, the air rises through the heat exchange chamber 87 in the direction of the arrow D, and is sent from the upper communication port 78 into the chamber 86 holding the substances being refrigerated. Since the air is cooled to a saturated state in the heat exchange chamber 87, no moisture is evaporated from the substances being refrigerated when the air is in direct contact with the substances in the holding chamber 86. The air is then circulated from the holding chamber 86 to the heat exchange chamber 87 through the lower communication port 79 by the blower 85. The refrigerant, in particular, the high-temperature refrigerant, is made to flow through the evaporator pipe 84 of the refrigerating machine 76 in the direction of the arrows E and a heat exchange is made between the refrigerant and air in the heat exchange chamber 87. Since the water from the injection nozzle 80 is sprayed against the evaporator pipe 84, no water freezes onto the pipe 84, and thus the heat exchange is performed very effectively.

As described above, the method of heat exchange according to the present invention is free from the freezing of moisture onto the evaporator pipe through which the refrigerant is circulating and, accordingly, the heat exchange is achieved thereby under optimum conditions constantly. Moreover, since low-temperature air in a saturated state containing tiny water droplets is used as the cooling air in the refrigerating device such as a refrigerated showcase or refrigerator whereto the method of heat exchange according to the present invention is applied, the vaporization of moisture from the substances being refrigerated is completely prevented even when the refrigeration is conducted by making circulated cooled air contact the substances directly. In addition, the flaming air can be purified by the atomized water. Therefore, the above regrigerating device and the refrigerator enable an especially excellent maintenance of the quality of perishable foods being refrigerated, and the values thereof as commodities for a long time, even when these foods are preserved and displayed at low temperature for a long time. Moreover, since the commodities can be displayed without being wrapped, the state thereof can be confirmed from outside very accurately. Thus, the present invention is very useful in a refrigerated showcase or a refrigerator and displays many advantages therefor.

While the invention has been described in detail above, it is to be understood that this detailed description is by way of example only, and the protection granted is to be limited only within the spirit of the invention and the scope of the following claims.

What is claimed is:

1. A method of providing a flow of air saturated with water comprising the steps of flowing air upwardly through a heat exchanger, positioning said heat exchanger generally vertically, providing an evaporator coil or a refrigerating machine inside said heat exchanger, providing a supply of water at the lower end of said heat exchanger, spraying water from said supply of water inside said heat exchanger onto said evaporator coil, flowing air to be saturated with said water through the inside of said heat exchanger in contact with said coil and with said sprayed water therein, and providing an amount of water in said step of spraying water larger than the amount of water said flow of air is capable of carrying, whereby the excess water in the form of the larger droplets thereof automatically returns to said supply of water by falling downwardly through said heat exchanger.

2. The method of claim 1, and filtering the water taken from said supply of water prior to said spraying water step to thereby purify the air and the water in the flow of water saturated air produced by the method.

3. The method of claim 1, and constricting the flow of water saturated air exiting the upper end of said heat exchanger to thereby cause a jetting effect thereof and to thereby assure removal of the larger droplets of water from said saturated flow.

4. The method of claim 1, and providing a portion of said evaporator coil in said water supply, whereby the water is precooled before said spraying step.

5. The method of claim 1, and providing a relatively high temperature refrigerant in said refrigerating machine, whereby the water sprayed on said evaporator coil does not freeze thereon.

6. The method of claim 5, wherein said refrigerant rates about 1° C. to about −5° C., and wherein water freezing on said coil is avoided due to the heat of vaporization of said sprayed water.

* * * * *